United States Patent [19]

Akiyoshi et al.

[11] 4,106,371

[45] Aug. 15, 1978

[54] CLAMPING TOOL

[75] Inventors: Toshio Akiyoshi; Tsutomu Onishi, both of Fukuoka; Shozo Haikawa, Kyoto, all of Japan

[73] Assignees: Mitsubishi Denki Kabushiki Kaisha, Tokyo; Kabushiki Kaisha Terauchi Seisakusho, Kyoto, both of Japan

[21] Appl. No.: 769,806

[22] Filed: Feb. 17, 1977

Related U.S. Application Data

[60] Division of Ser. No. 683,874, May 6, 1976, which is a continuation of Ser. No. 450,921, Mar. 13, 1974, abandoned.

[51] Int. Cl.[2] ..... B25B 29/00

[52] U.S. Cl. ..... 81/57.14; 81/57.31; 81/124.1

[58] Field of Search ..... 81/52.4 R, 56, 124.1, 81/57.11–57.14, 57.29, 57.30; 74/640, 801, 800

[56] References Cited

U.S. PATENT DOCUMENTS

| | | | |
|---|---|---|---|
| 2,506,835 | 5/1950 | Johnson | 81/124.1 |
| 2,704,952 | 3/1955 | Mooter | 81/124.1 |
| 3,041,902 | 7/1962 | Wing | 81/56 |
| 3,222,954 | 12/1965 | Wuertz | 74/801 |

OTHER PUBLICATIONS

Harmonic Drive, United Shoe Machinery, p. 12, 1962.

*Primary Examiner*—James L. Jones, Jr.
*Attorney, Agent, or Firm*—Sughrue, Rothwell, Mion, Zinn and Macpeak

[57] ABSTRACT

A clamping or power wrench tool for tightening a bolt, nut and the like comprising a power shaft engaging the bolt, nut and the like, a driving power source of electromotive, pneumatic or hydraulic type, an anti-reaction force member for the prevention of rotation of the tool case due to the reaction force, a harmonic drive mechanism as the speed reduction mechanism between the power shaft and the driving power source, planetary gear device provided between the harmonic drive mechanism and the power shaft, a first mechanism engaged with a nut screwed to a torque set bolt and rotating the nut with the rotation of the power shaft thereby tightening the nut, a second mechanism engaged to the torque set bolt in such a way as to break the torque set bolt at a predetermined position when the tightening torque arrives at a predetermined value in the course of the clamping and a knock out mechanism which discharges the broken piece of the torque set bolt out of the case by means of a spring force.

8 Claims, 16 Drawing Figures

CLAMPING TOOL

This is a division of Ser. No. 683,874, filed May 6, 1976, which is a continuation application of Ser. No. 450,921, filed Mar. 13, 1974, now abandoned.

BACKGROUND OF THE INVENTION

1. Field of the Invention

This invention relates to a clamping tool or power wrench having a driving power source and a power shaft engaging, for example, with a bolt, nut or the like connected to said driving power source by way of a speed reduction mechanism.

2. Description of the Prior Art

This invention relates to a clamping tool or power wrench of electromotive, hydraulic and pneumatic type and the like which clamping a torque set bolt, usual bolt and the like to a clamps member.

In the known clamping tools or power wrenches of this type, the rotation of a driving power source is transmitted by way of a speed reduction device to a power shaft and clamping a body such as a bolt, nut, etc. is fitted to and rotated together with a power shaft to thereby tightly clamp said clamped body. In such a construction, however, when a tightening torque arrives at a predetermined level, the reaction force thereof is directly exerted on a worker carrying the tool to increase his fatigue. Some time, the reaction force even goes beyond the grasping force of the worker, which forces him to drop the tool to damage the same or even causes human accidents.

SUMMARY OF THE INVENTION

An object of this invention is to provide a clamping tool or power wrench having a driving power source and a power shaft engaging, for example, with a bolt, nut or the like connected to said driving power source by way of a speed reduction mechanism wherein said clamping tool is provided with an anti-reaction mechanism which prevents the rotation of the case of the clamping tool caused by the reaction force exerted on said case as the clamping proceeds.

Another object of this invention is to provide such clamping tool in which a harmonic drive mechanism is used as a speed reduction mechanism in order to prevent the rotation of case of the tool due to the reaction force generated at the time of clamping.

A further object of this invention is to provide a clamping tool or power wrench which is small in size and having a high reduction ratio.

Still further object of this invention is to provide such clamping tool or power wrench in which the service life of the speed reduction mechanism is prolonged.

Another object of this invention is to provide a clamping tool or power wrench capable of discharging the unnecessary cut off portion of bolt, nut or the like out of the case of the tool.

These and other objects and advantages of this invention will become apparent by the following detailed description of this invention referring to the accompanying drawing.

DESCRIPTION OF THE ACCOMPANYING DRAWING

PREFERRED EMBODIMENT OF THE INVENTION

Figure 1:
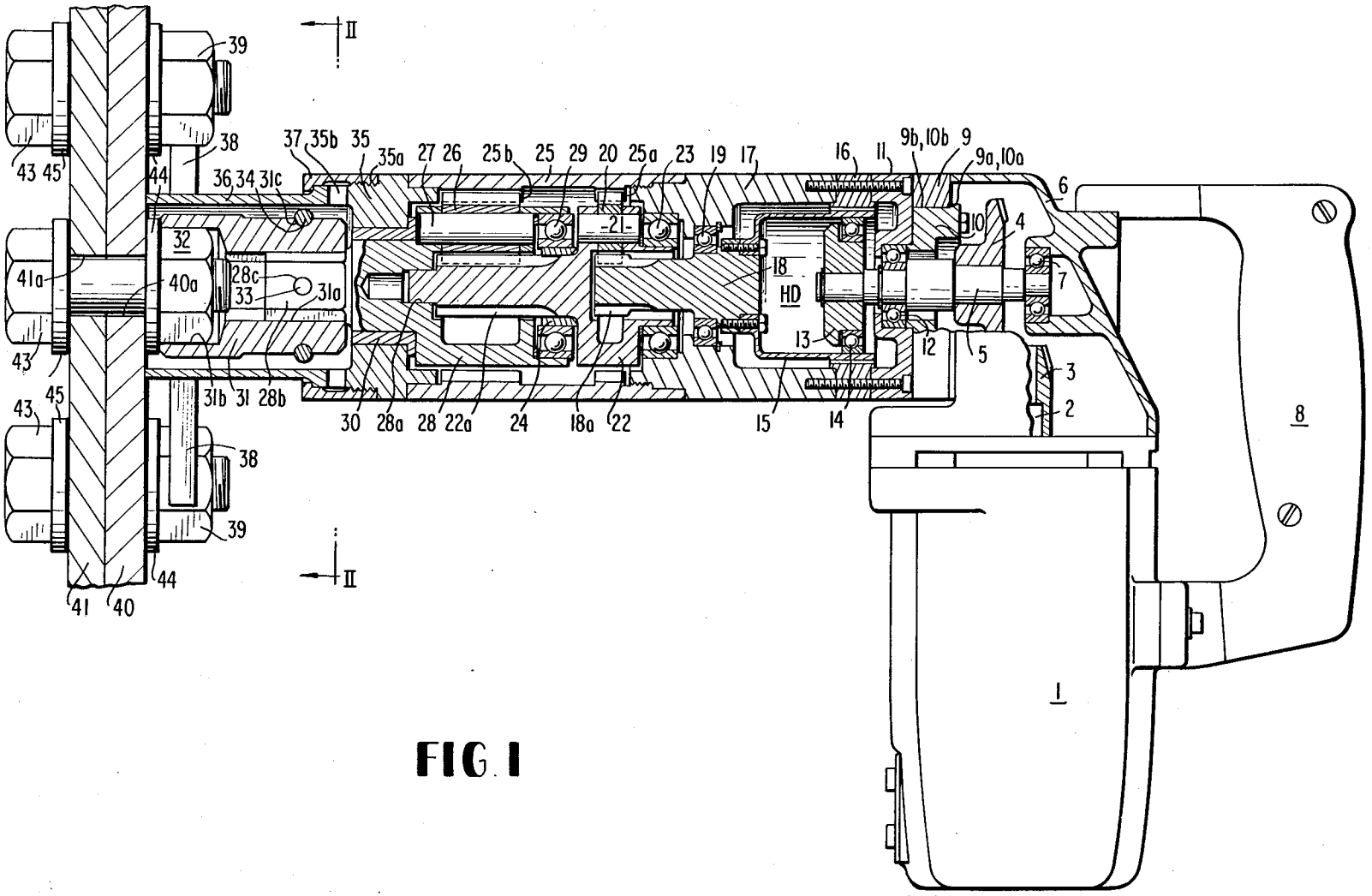
FIG. 1 is a partially cut away elevation of a first embodiment of this invention.
Figure 2:
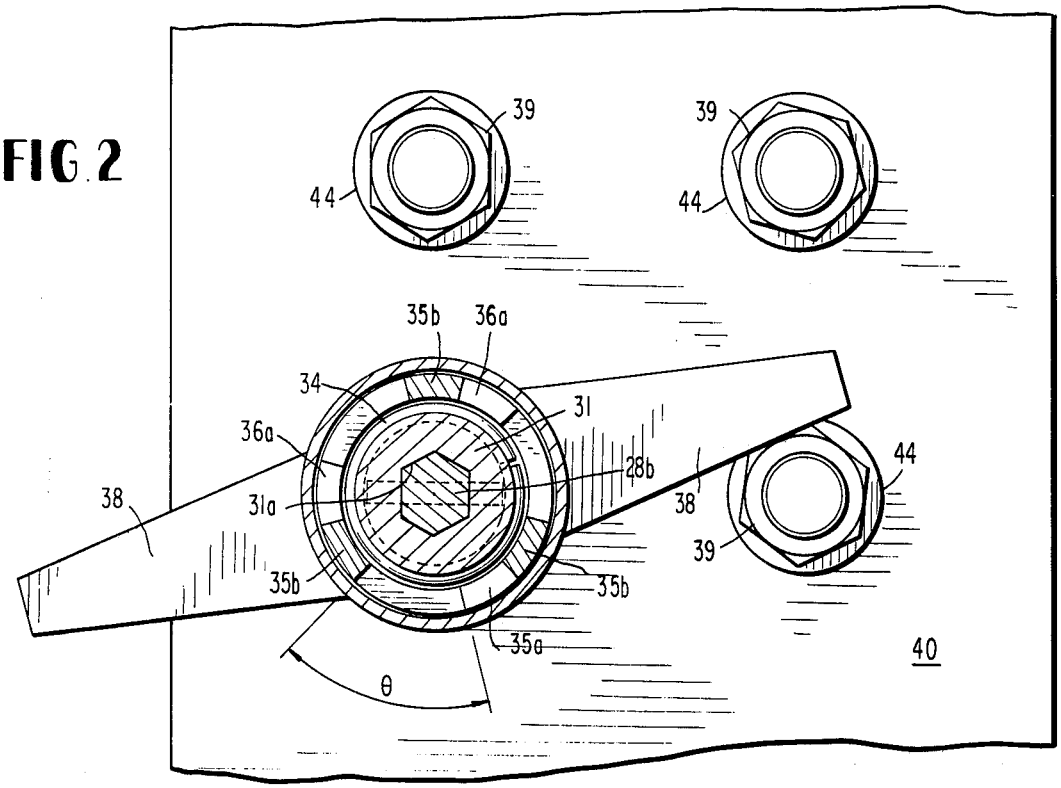
FIG. 2 is a section of a part of the embodiment shown in FIG. 1 taken along the line II—II of FIG. 1.

This invention is to be described in details by way of preferred embodiments of a power clamping tool or power wrench, referring to the accompanying drawing and, at first embodiment of this invention particularly referring to FIG. 1 and FIG. 2, wherein reference numeral 1 denotes a frame for the driving power source such as an electric motor, hydraulic motor, pneumatic motor, etc. (not shown), 2 a rotating shaft for said driving power source, 3 a small bevel gear fitted in the proximate end of said rotating shaft 2, 4 a large bevel gear engaging said small bevel gear 3 and rotating at reduced speed, 5 a rotating shaft fitted to said large bevel gear 4, 6 a gear box connected to said frame 1, housing said small and large bevel gears 3 and 4 and supporting rotatably, said rotating shaft 5 by way of ball bearings 7. 8 denotes a handle riding over said frame 1 and said gear box 6, 9 a first stop plate connected to said gear box 6 and having sliding surfaces 9A and 9B. 10 denotes a second stop plate loosely engaging therein said rotating shaft 5 and having sliding surfaces **10*a* and 10*b* that slide with said sliding surfaces 9*a* and 9*b* to each other. 11 denotes a bearing support connected to said second stop plate 10 and rotatably supporting said rotating shaft 5 by way of a ball bearing 12. HD identifies a well-known harmonic drive mechanism as a speed reduction device and composed of a wave generator, flexspline, internal gear and the like as describe hereinafter. 13 denotes an elliptical wave generator fitted to the end of said rotating shaft 5, 14 ball bearings fitted to the outer periphery of said wave generator 13, 15 a flexspline of resilient material having U-shaped section, provided along the outer periphery of said ball bearings 14 and provided with predetermined numbers of external teeth at the outer cylindrical surface thereof. The flexspline 15 is connected to said ball bearing 14 while flexing in the shape of an ellipse so as to correspond with the outer periphery of said ball bearing 14. 16 denotes an internal gear which is connected to said ball bearing support 11 and also provided with inner teeth engaging with said external teeth of said flexspline 15 at the inner surface opposing to said flexspline 15 and exceeding the number of said inner teeth of said flexspline 15 by one or two. 17 denotes a first case connected to said internal gear 16, 18 a sun gear shaft connected to said flexspline 15 and rotatably supported to said first case 17 by way of ball bearings 19. 18***a* denotes a first sun gear provided on the outer periphery of said sun gear shaft 18, and 20 are plural first planetary gears gearing with said first sun gear 18*a* and revolving with autorotation. 21 denotes a first planetary gear shaft which rotatably supports said first planetary gears 20, 22 a first planetary gear stand on which said first planetary gear shaft is connected and which is, in turn, rotatably supported by metal ring 24, 22*a* denotes a second sun gear provided on the outer periphery of the top of the first planetary stand 22, 25 a second case connected to said first case 17 and 25*a* is a first internal gear provided at the inner periphery of said second case 25 and gearing with said first planetary gear 20. 25*b* is a second internal gear provided at the other inner periphery of said second case 25 and 26 plural second planetary gears meshing with said internal gear 25*b* and which revolve with autorotation. 27 denotes a second planetary gear shaft which rotatably supports said second planetary gear 26 and which is, in turn, supported by metal ring 30. 28*a* denotes a circular hole or bore having a bottom end provided at one end of the inner periphery of said second planetary gear stand 28 and losely engages the top of said first planatary stand 22 therein. 28*b* denotes a hexagonal projection formed at one end of said second planetary gear stand 28, 28*c* is an aperture passing through the center of the hexagonal projection 28*b*, 31 is a receptacle having at the inner periphery of one end thereof a hexagonal aperture 31*a* engaging the projection 28*b* of aforesaid hexagonal configuration, in which an aperture communicating said hexagonal aperture 28*c* is provided, and is formed with a hexagonal hole 31*b* engaging with a nut 32 at the inner periphery of the other end, 31*c* is a semi-circular ring groove formed at the outer periphery of said receptacle 31, 33 an anti-slip off pin for said receptacle 31 provided within the aperture of said receptacle 31 and said aperture 28*c* in said hexagonal projection 28*b* and 34 an O-ring fitted to said ring groove 31*c* for the prevention of slipping off said pin 33. 35 denotes a bearing support connected at one end thereof to said case 25 and fitted with said metal ring 30 at the inner periphery thereof. 35*a* denotes a male screw formed at the outer periphery of the other end of said bearing support 35, 35*b* projections formed at the top of the other end of said bearing support 35 at an interval of 120° as shown in FIG. 2 and 36 a sleeve provided around the outer periphery of said receptacle 31 spaced apart concentrically therefrom and provided on one end thereof engaging portions 36*a* for engaging said projections 35*b* of said bearing support 35 at an interval of 120°. 37 denotes a joint to be screwed with said male screw 35*a* of said bearing support 35 and detachably connecting said sleeve 36 to said bearing support 35. 38 is an anti-reaction force member coupled to said sleeve 36 at an interval of 180° as shown in FIG. 2 and it is adapted so as to be capable of engaging an adjacent nut 39. 40 and 41 denote a pair of articles to be clamped, 43 a bolt inserted through apertures 40*a* and 41*a* for each of said clamped article 40 and 41 respectively and 44 and 45 washers losely fitted to said bolt 43 respectively.

The operation of the above described embodiment of the power wrench having the foregoing construction is to be described in clamping a pair of articles by way of a bolt 43 and a nut 42. A bolt 43 is inserted through apertures 40*a* and 41*a* of the clamped articles 40 and 41, and fitting up is effected by a nut 32 with fitting washers 44 and 45 to the bolt 43. The nut 32 is then fitted into a hexagonal hole 31*b* of a receptacle 31 and an anti-rotation member 38 is engaged with an adjacent nut 39 that was previously tightened to the clamped member 40. Then, by rotating a driving power source in the direction of clamping, a rotating shaft 2 is rotated. This rotation moment of said rotating shaft 2 is transmitted through a small bevel gear 3, a large bevel gear 4, a rotating shaft 5, a wave generator 13 and ball bearings 14 in speed reduction manner. The rotation of said ball bearings 13 expands the outer periphery of a flexspline 15 at two location into an elliptic shape. The flexspline 15 meshes with an internal gear 16 and further reduced in speed. The rotation of the flexspline 15 is transmitted through a first sun gear shaft 18, a first sun gear 18*a*, a first planetary gear 20, a first planetary gear shaft 21, a first planetary gear stand 22, a second sun gear 22*a*, a second planetary gear 26, a second planetary gear shaft 27, and a second planetary gear stand 28 to a receptacle 31 and causes to rotate said receptacle at a reduced speed thereby gradually screwing the nut 32 into the bolt 43 tightly thus to tighten the clamped articles 40 and 41. The receptacle 31 rotates at the rotation frequency N' represented by the following formula:

$$N' = \frac{Z_1}{Z_2} \cdot \frac{(Z_4 - Z_3)}{Z_3} \cdot \frac{1}{(1 + \frac{Z_6}{Z_5})} \cdot \frac{1}{(1 + \frac{Z_8}{Z_7})} \times N,$$

wherein N stands for the number of revolution of the rotating shaft 2, $Z_1$ number of teeth of the small bevel gear 3, $Z_2$ that of the large bevel gear 4, $Z_3$ that of the flexspline 15, $Z_4$ that of the internal gear 16, $Z_5$ that of the first sun gear 18*a*, $Z_6$ that of the first internal gear 25*a*, $Z_7$ that of the second sun gear 22*a* and $Z_8$ that of the second internal gear 25*b*.

As apparent from the equation above, the receptacle 31 is rotated at a greatly reduced speed and tightens the clamped article 40 and 41 with a great tightening torque. Then, as the tightening torque for the clamped articles 40 and 41 gradually increases, the reaction force of the tightening torque is also increased in proportion thereto but since the anti-rotation member 38 integrated with the tool body is engaged with the adjacent nut 39, the rotation of the tool due to the reaction force can be prevented and, therefore, the reaction force is not exerted to the worker who carry the tool.

It may some time occur during the clamping process such accidents that the bolt, to which the adjacent nut 36 engaged with the anti-rotation member 38 is screwed, is broken due to the fatigue caused by the reaction force of the tightening torque, or the anti-rotation member is disengaged from the adjacent nut 39 by the deformation, or further the anti-rotation member 38 itself is broken. In such cases, however, the first stop plate 9, the gear box 6 and the frame 1 are not rotated against the tendency of the tool to rotate due to the reaction force of the tightening torque although the rotation is allowed for the sleeve 36, the bearing support 35, the second case 25, the first case 17, the internal gear 16, the bearing support 11 and the second stop plate 10 because of the provision of the sliding surfaces 9*a*, 9*b*, 10*a* and 10*b* between the stop plates 9 and 10.

Figure 3:
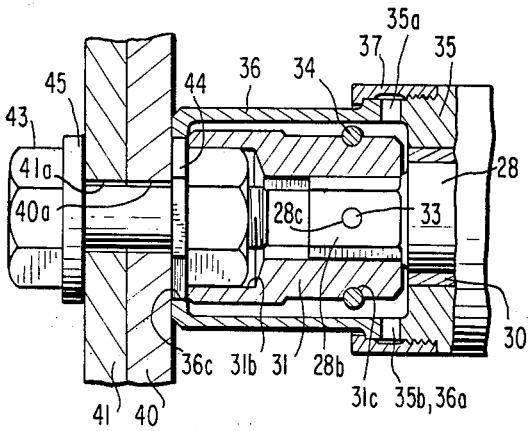
FIG. 3 is a partially cut away elevation of a second embodiment of this invention.

The second embodiment of this invention will now be described referring to FIG. 3, wherein the reference numeral 36 denotes a sleeve having at one end engaging portion 36*a* provided at an interval of 120° so as to engage with the projections 35*b* provided at the top of the bearing support 35 also at an interval of 120°, and having at the other end thereof a hexagonal engaging portion 36*c*. 44 is a hexagonal washer to be fitted to said hexagonal engaging hole 36*c* and tightly fitted to the bolt 43. Other constructions are omitted to explain since they are the same as the first embodiment.

In this second embodiment, a pair of articles to be clamped are clamped by way of a bolt 43 and a nut 32 as below: The bolt 43 is inserted through apertures 40*a* and 41*a* of the clamped articles 40 and 41 respectively and a nut 32 is screwed to the bolt 43 with a washer 45 fitting to said bolt 43 and a hexagonal washer 44 fitting tightly to said bolt 43. Then, the nut 32 is fitted into the hexagonal hole 31*b* of the receptacle 31 while fitting the hexagonal washer 44 in the hexagonal fitting hole 36*c* and the receptacle is rotated just the same way as in the first embodiment. In this case, the nut 32 gradually tightens the clamped articles 40 and 41 being rotated by the receptacle 31 and the hexagonal washer 44 also tightens the clamped articles 40 and 41 gradually while moving axially around the outer periphery of the bolt 43 toward the clamped article 40 in the state locked to the sleeve 36 as the nut 32 moves. Thus, as the tightening torque to the clamped articles 40 and 41 increases gradually, the reaction force of said torque is also increased in proportion thereto. However, since the hexagonal engaging hole 36*c* is engaged with the hexagonal washer 44, the rotation of the tool due to the reaction force is inhibited and the reaction force is not exerted on the worker carrying the tool. In the case if the engagement between the hexagonal washer 44 and the sleeve 36 should be lost because of certain reasons in the cource of the clamping under the state described above, the handle 8 carried by the worker is not rotated since the sliding is effected at the sliding surfaces 9*a*, 9*b*, 10*a* and 10*b* between the first stop plate 9 and the second stop plate 10.

Figure 4:
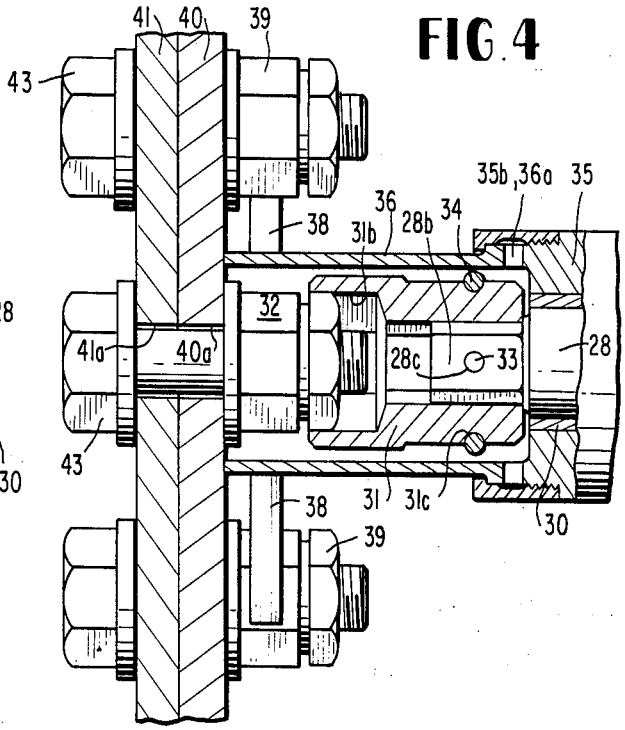
FIG. 4 is a partially cut away elevation of the third embodiment of this invention.

The third embodiment of this invention is to be described referring to FIG. 4, wherein a reference numeral 32 is a special nut which is screwed with a bolt 43. Other constructions and the operation thereof are omitted to explain since they are quite the same as the first embodiment.

Figure 6:
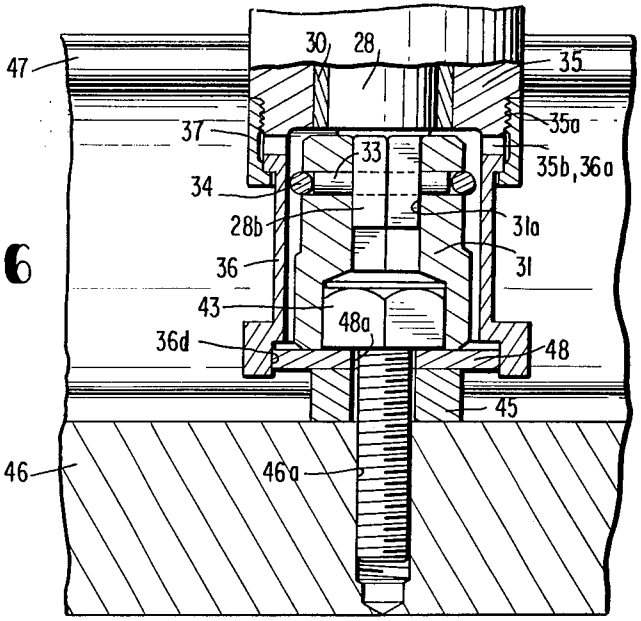
FIG. 6 is a section taken along line VI—VI of FIG. 5.
Figure 5:
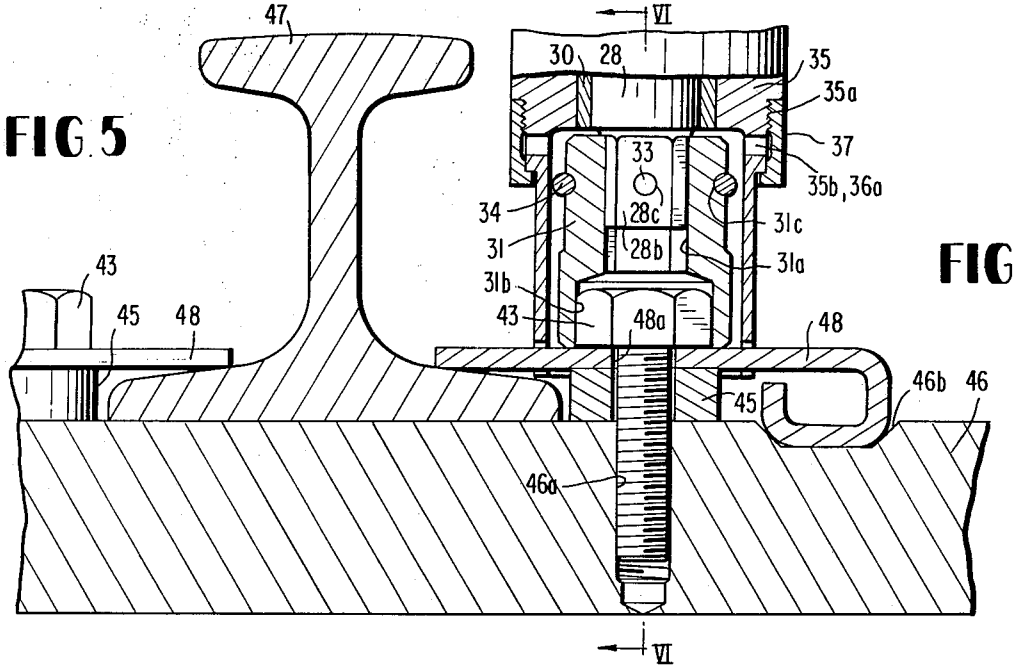
FIG. 5 is a partially cut away elevation of a fourth embodiment of this invention.

The fourth embodiment of this invention is to be described referring to FIG. 5 and FIG. 6, wherein the reference number 46 denotes a cross tie made of steel material, for example, 46*a* female screws previously provided in said cross tie 46 (only one is shown in the drawing), 46*b* recesses provided in predetermined positions of said cross tie 46 (only one is shown in the drawing) and 47 a track mounted on said cross tie and situated so as to locate at the intermediate of said female screw 46*a*. 45 denotes a hollow circular washer mounted just above said female 46*a*. 48 denotes a track clip abutting at one end thereof to the lower portion of said track 47 and fitted at the other bent end into the recess 46*b* of said cross tie 46 and it is mounted on said washer 45. 48*a* is an aperture provided in the center of said track clip 48, 43 a bolt screwing said track clip 48 into said female screw 46*a*, and 36 a sleeve having at one end thereof engaging portions 36*a* provided at an interval of 120° so as to engage with the projections 35*b* formed at the top of the bearing support 35 also at an interval of 120° and having at the other end an opening 36*d* of a dimension corresponding to the lateral size of said track clip 48 as shown in FIG. 6. The other constructions are omitted to explain since they are the same as in the first embodiment of this invention.

In the above described embodiment having the foregoing construction, the track 47, for example, is clamped to the cross tie 46 by means of the bolt 43 by way of a track clip 48 as described below. The washer 45 is placed just above the female 46*a* of the cross tie 46. The track clip 38 is placed on the washer 45 with one end thereof fitted to the lower part of the track 47 and the other end being engaged into the recess 46*b* of the cross tie 46. Then, the bolt 43 is inserted through the aperture 48*b* of the track clip 48 and the aperture of the washer 45 and screwed into the female screw 46*a* of the cross tie 46. In this conditions, the hexagonal hole 31*b* of the receptacle 31 is fitted to the head of the bolt 43 and the opening 36*d* of the sleeve 36 is fitted to the track clip 48 and then the receptacle 31 is rotated in the same manner of operation as in the first embodiment. In this case, the bolt 43 is rotated by the receptacle 31 and gradually tightens the track clip 48 to the cross tie 46. Thus, as the tightening torque to the track clip 48 gradually increases, the reaction force of said turque is also increased in proportion thereto. However, since the sleeve 36 is engaged with the track clip 48, the rotation of the tool by means of said reaction force is prevented and the reaction force is not exerted on the worker carrying the tool.

In case if the engagement between the track clip 48 and the sleeve 36 should be lost by any reason in the course of the clamping work, the handle 8 carried by the worker would not be rotated since the sliding is effected at the sliding surfaces 9*a*, 9*b*, 10*a* and 10*b* between the first stop plate 9 and the second stop plate 10 as in the first embodiment.

Figure 8:
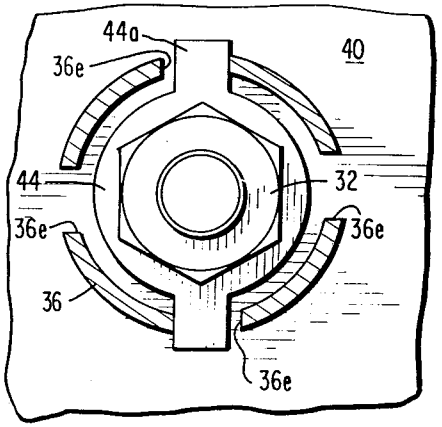
FIG. 8 is a section taken along line VIII—VIII of FIG. 7.
Figure 7:
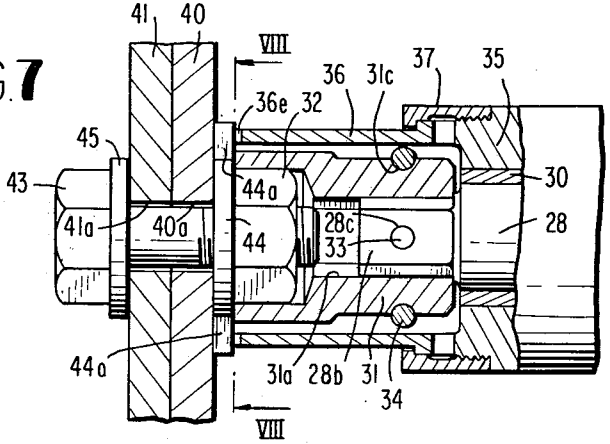
FIG. 7 is a partially cut away elevation of a fifth embodiment of this invention.

The fifth embodiment shown in FIGS. 7 and 8 is to be described. In the figures, 35 denotes a sleeve having at one end thereof engaging positions formed at an interval of 120° so as to engage with the projections 35*b* formed at the top of the bearing support 35 also at an interval of 120° and having at the other end thereof notched grooves 36*e* with predetermined depth and set at four positions symmetrical positions of the outer periphery thereof and tightly fitted to the bolt 43. Other constructions are omitted to explain since they are the same as in the first embodiment of this invention.

The operation of the foregoing embodiment is effected as below: The bolt 43 is inserted through the apertures 40*a* and 41*a* of the articles to be clamped 40 and 41 and the nut 32 is screwed with bolt 43 with losely fitting the washer 45 to the bolt 43 and tightly fitting the washer 44 to the bolt 43. Then, the nut 32 is fitted into the hexagonal hole 31*b* of the receptacle 31 while engaging two notched grooves 36*e* of the sleeve 36 to two projections 44*a* of the washer 44 and the receptacle 31 is rotated in the same way as in the first embodiment. The nut 32, rotated by the receptacle 31, gradually tightens the clamped articles 40 and 41 and the washer 44 also tightens the clamped articles 40 and 41 by being moved axially aroung the outer periphery of the bolt 43 toward the clamped article 40 in the state locked to the sleeve 36 as the nut 32 travels axially. Thus, as the tightening torque to the clamped articles 40 and 41 gradually increases, the reaction force of said torque is also increased. However, since the notched grooves 36*e* of the sleeve are engaged to the projections 44*a* of the washer 44, the rotation of the tool is prevented and the reaction force is not exerted on the worker carrying the tool. In the case if the projections 44*a* of said washer 44 is broken by the fatigue in the cource of proceeding the clamping work, the handle 8 carried by the worker would not be rotated since sliding is effected at the sliding surfaces 9*a*, 9*b*, 10*a* and 10*b* between the stop plate 9 and stop plate 10 as in the first embodiment of this invention.

Figure 9:
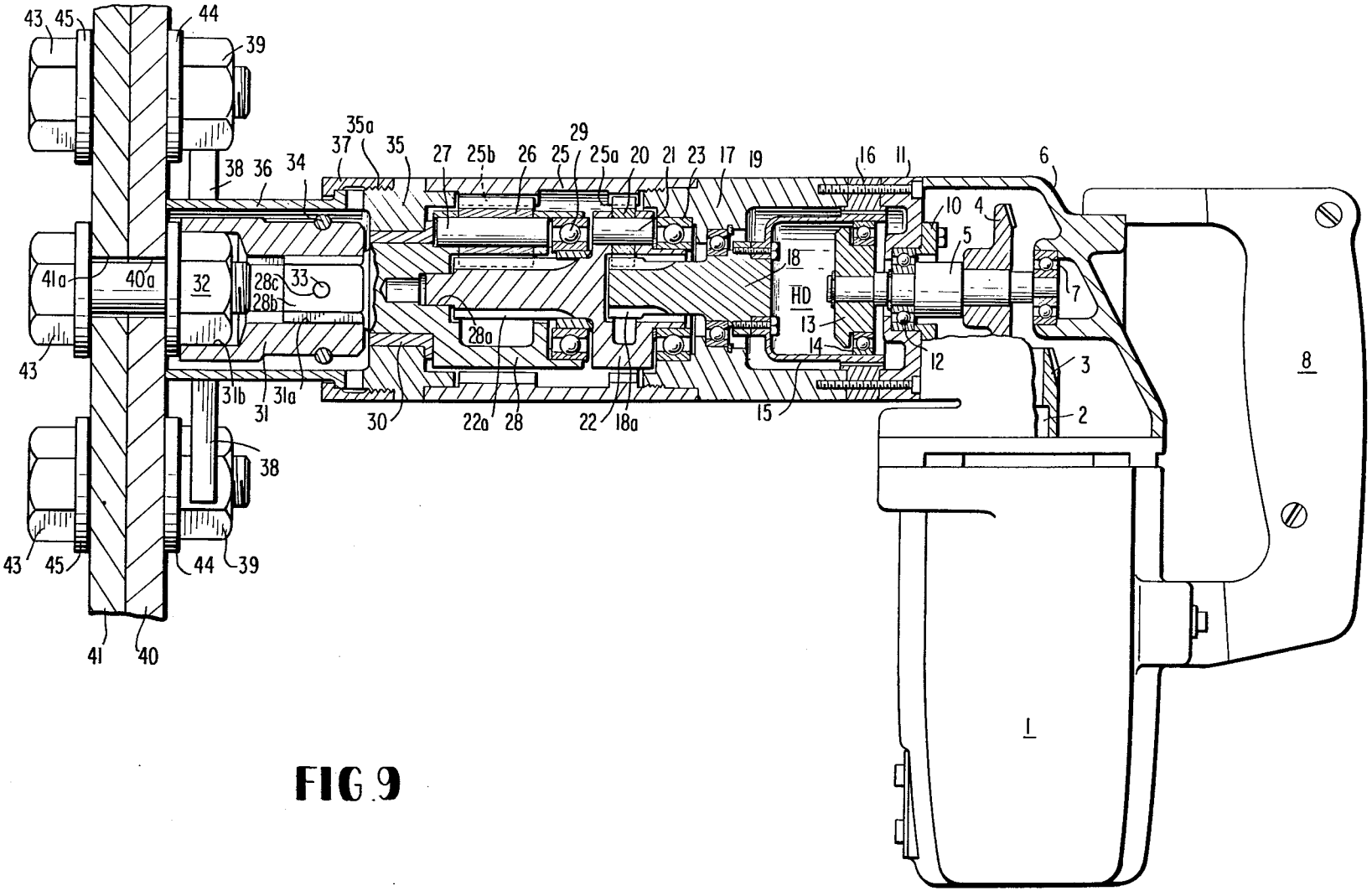
FIG. 9 is a partially cut away elevation of a sixth embodiment of this invention.

The sixth embodiment of this invention is to be described referring to the FIG. 9, wherein the reference numeral 6 denotes a gear box containing a small bevel gear 3 and a large bevel gear 4 and connected at one end thereof to the frame and the other end thereof to the bearing support 11. 110 denotes a stop plate coupled to said bearing support 11. Other constructions are the same as in the first embodiment of this invention and, therefore, omitted to explain.

It is, however, course, possible to replace the sleeve 36 with one having hexagonal engaging hole 36*c* at the top thereof as described in the second embodiment and the washer 44 with a hexagonal washer. It is also possible to substitute the track clip 48 for the washer 44.

The operation of the above described embodiment having the foregoing construction is approximately the same as those of the embodiments 1, 2 and 4 excepting that there are no rotation with the tool because of the absence of the sliding portions 9*a*, 9*b*, 10*a* and 10*b*.

Figure 10:
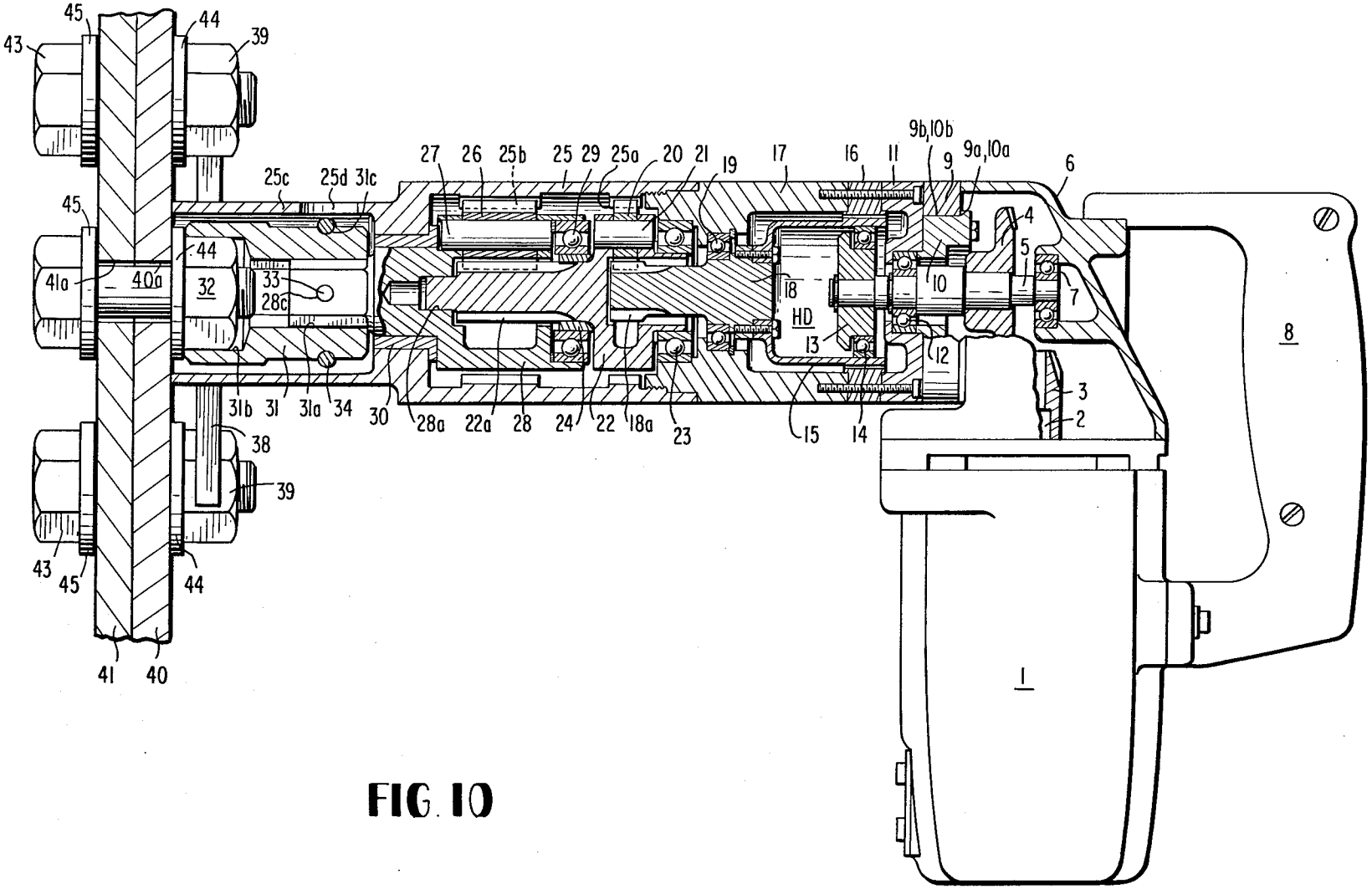
FIG. 10 is a partially cut away elevation of a seventh embodiment of this invention.

The seventh embodiment of this invention is to be described referring to FIG. 10, wherein the reference numeral 25*c* denotes a sleeve integratedly formed with the case 25 and connected with the anti-reaction member 38 at an interval of 120° at the periphery thereof. 35*d* denotes an aperture provided through said sleeve 25*c* for the insertion of the pin 33 after engaged to the hexagonal projections 28*b* of the second planetary gear stand 28. Other constructions are omitted to explain since they are the same as in the first embodiment.

The operation of the above described embodiment having the foregoing construction is approximately the same as in the embodiment 1 excepting that the sleeve 25*c* neither rotates nor disengages solely since the sleeve 25*c* is formed integratedly with the second case.

Figure 11:
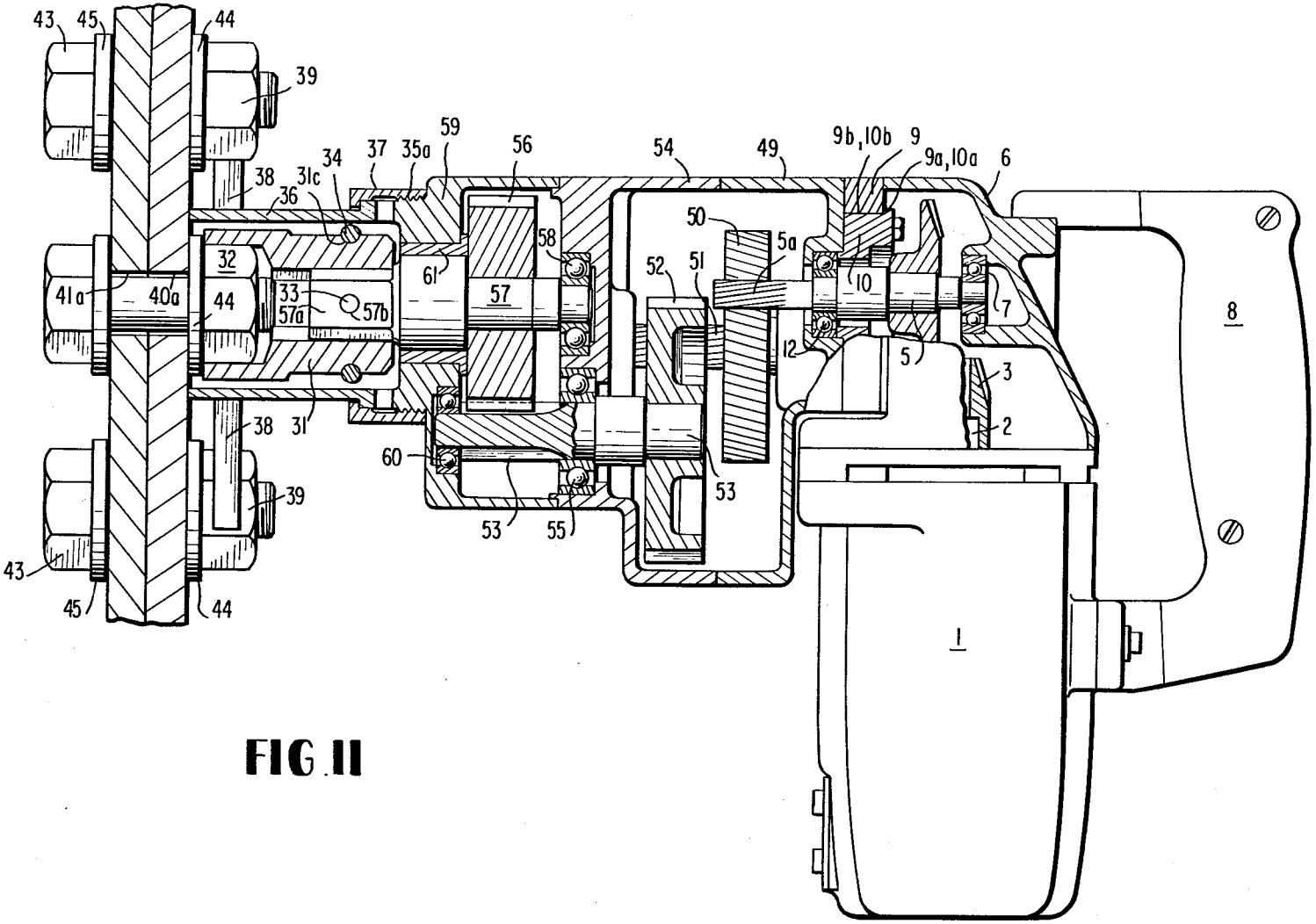
FIG. 11 is a partially cut away elevation of a eighth embodiment of this invention.

The eighth embodiment of this invention is to be described referring to FIG. 11, wherein the reference number 1 denotes a frame for the driving power source such as an electric motor, hydraulic motor, pneumatic motor, etc. (not shown), 2 rotating shaft for said driving power source, 3 a small bevel gear fitted in the proximity of the end of said rotating shaft 2, 4 a large bevel gear engaging with said small bevel gear 3 in the speed reduction manner, 5 a rotating shaft fitted to said large bevel gear 4, 5*a* a first gear formed at the top of said rotating shaft 5*a* a first gear formed at the top of said rotating shaft 5*a*, 6 a first gear box connected to said frame 1 and connecting said small and large bevel gears 3 and 4 and it rotatably supports said rotating shaft 5 by way of ball bearings 7. 8 denotes a handle coupled to said frame 1 and a first gear box 6 overriding them, 9 a first stop plate connected to said gear box 6 and having sliding surfaces 9*a* and 9*b* and 10 a second stop plate losely engaging therein said rotating shaft 5 and having sliding surfaces 10*a* and 10*b* sliding to said sliding surfaces 9*a* and 9*b* of said first stop plate 9. 49 is a second gear box connected to said second stop plate and rotatably supporting said rotating shaft 5 by way of the ball bearings 12. 50 is a second gear engaging with said first gear 5*a* in the speed reduction manner and 51 a third gear fitted to said second gear 50 and supported rotatably by way of a ball bearings not shown. 52 denotes a fourth gear engaging with said third gear 51 in a speed reduction manner and 53 is a rotating shaft fitted to said fourth gear 52 and formed at one end thereof with a fifth gear 53*a*. 54 is a third gear box connected to said second gear box 49 and it rotatably supports said rotating shaft 53 and contain together with said second gear box 49 said first, second, third and fourth gears 5*a*, 50, 51 and 52. 56 denotes a sixth gear engaging with said fifth gear 53*a* in the speed reduction manner, and 57 a power shaft fitted to said sixth gear 56 and supported rotatably at one end thereof to said third gear box 54 by way of ball bearings 58. 57*a* denotes a hexagonal projection formed at the other end of said power shaft 57, 57*b* an aperture provided through the center of said hexagonal projection 57*a* and 59 a fourth gear box connected to said third gear box 54 and it rotatably supports said power shaft 57 by way of a metal ring. 61, 35*a* denotes a male screw formed at the outer periphery of one end of said fourth gear box 59 and 35*b* projections provided at the top of said fourth gear box 59 at an interval of 120° as shown in FIG. 2. Other constructions are omitted to explain since they are the same as in the first embodiment of this invention. It is possible to replace the sleeve 36 in this embodiment with one having at the top thereof a hexagonal engaging hole 36*c* as described in the embodiment 2 and the washer 44 with a hexagonal washer. It is also possible to substitute the sleeve 36 with one described in the fourth embodiment and the washer 44 with a track clip 48.

The operation of the above described embodiment having the foregoing construction is to be described for clamping the clamped articles 40 and 41 with a bolt 43 and a nut 32. The bolt 43 is inserted through apertures 40*a* and 41*a* of the clamped articles 40 and 41 and the nut 32 is fitted with fitting washers 44 and 45 to the bolt to effect the fitting up. Then, the nut 32 is fitted into the hexagonal hole 31*b* of the receptacle 31 and the antirotation member 38 is engaged to an adjacent nut 39 previously clamped to the clamped articles 40 and 41, and the rotating shaft 2 is rotated by rotating the driving power source in the direction of clamping. The rotation moment of said rotating shaft 2 is transmitted through a small bevel gear 3, a large bevel gear 4, rotating shaft 5, a first gear 5*a*, a second gear 50, a third gear 51, a fourth gear 52, a rotating shaft 53, a fifth gear 53*a*, a sixth gear 56, and a power shaft 57 to the receptacle 31 and said receptacle is rotated in the reduced speed. Thus, the nut is gradually screwed to the bolt tightly thereby clamping a pair of the clamped articles 40 and 41 tightly. The receptacle 31 is rotated at the number of revolution as represented by the following equation causing the nut 32 to rotate:

$$N' = \frac{Z_1 \cdot Z_3 \cdot Z_5 \cdot Z_7}{Z_2 \cdot Z_4 \cdot Z_6 \cdot Z_8} \times N$$

wherein N represent the number of revolution of the rotating shaft 2, $Z_1$ the number of the teeth of the small bevel gear 3, $Z_2$ that of the large bevel gear 3, $Z_3$ that of the first gear 5*a*, $Z_4$ that of the second gear 50, $Z_5$ that of the third gear 51, $Z_6$ that of the fourth gear 52, $Z_7$ that of the fifth gear 53*a* and $Z_8$ that of the sixth gear 56.

As apparent from the above equation, the receptacle 31 rotates at a great speed reduction ratio and clamps the clamped articles 40 and 41 with a great tightening torque. Thus, as the tightening torque to the clamped articles 40 and 41 increases, the reaction force of the tightening torque is also increased in proportion thereto. However, the rotation of the tool can be prevented and the reaction force of the torque is not exerted on the worker carrying the tool since the anti-rotation member integratedly formed with the tool is engaged with the adjacent nut 39.

It may occur such an accident that the bolt screwed with the adjacent nut 39 engaging with the anti-rotation member 38 integratedly formed with the tool is broken by the fatigue caused by the reaction force of the tightening torque, or the anti-rotation member 39 is disengaged from the adjacent nut 39 due to the deformation, or further the anti-rotation member itself is broken in the course of proceeding the clamping work. However, the first stop plate 9, first gear box 6 and the frame 1 are not rotated against the tendency of the tool to rotate due to the reaction force of the tightening torque although the sleeve 36, joint 37, the fourth gear box 59, the third gear box 54, the second gear box 49, and the second stop plate 10 are allowed to rotate because of the presence of the sliding surfaces 9*a*, 9*b*, 10*a* and 10*b* between the stop plates 9 and 10.

The descriptions have been made for the operation of this embodiment with respect to the construction wherein the anti-reaction force member 38 is coupled to the sleeve 36, but it is, of course, possible to replace the sleeve 36 with one described in the embodiment 2 and substitute the washer 44 with the hexagonal washer as used in the second embodiment to obtain the same anti-reaction force effect as in the embodiment 2. It is also possible to replace the sleeve 36 with one described in the embodiment 4 and substitute the washer 44 with the track clip 48 as described in the same embodiment to obtain the same anti-reaction force effect as in the embodiment 4.

Figures 12, 13:
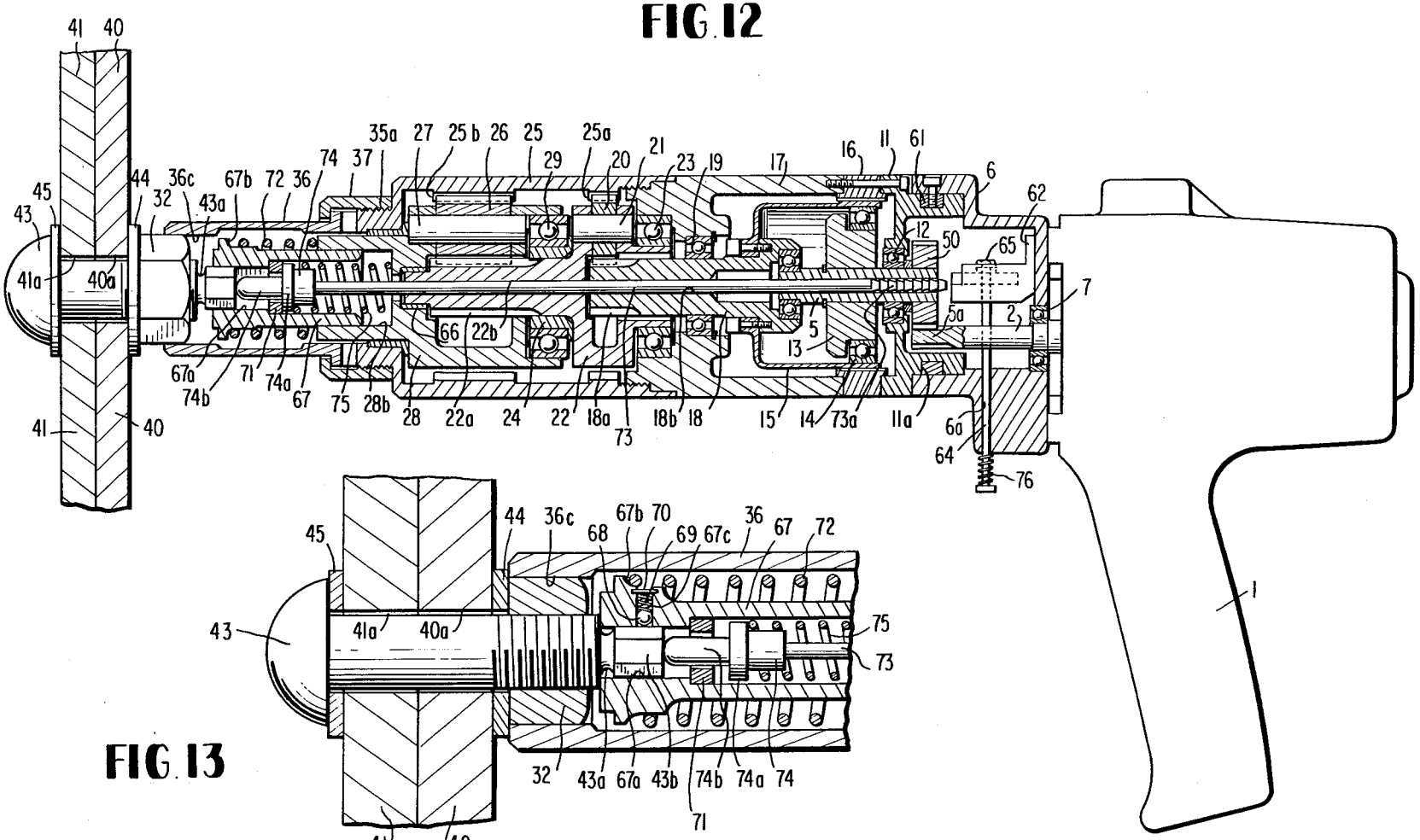
FIG. 12 shows a partially cut away elevation of a ninth embodiment of this invention at the early stage of fitting a nut sleeve to a nut.
FIG. 13 shows a section of a portion of the top of FIG. 12 as the nut sleeve is completely fitted to the nut.
Figure 14:
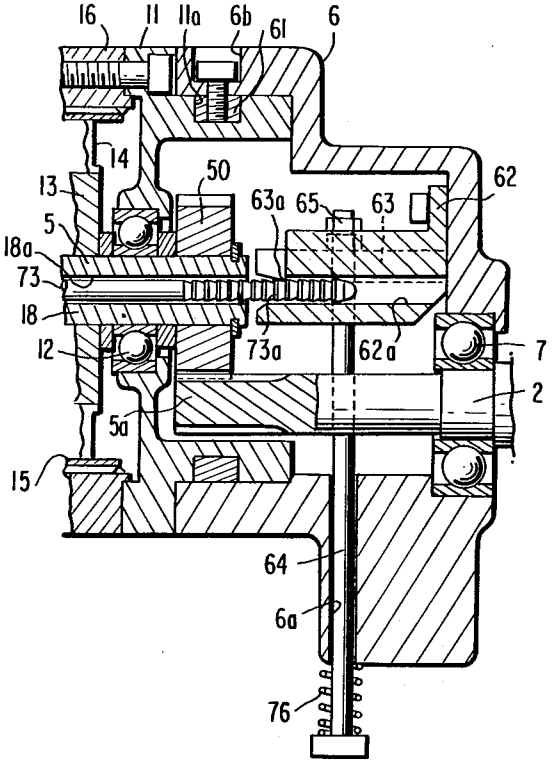
FIG. 14 shows a section of a portion of the rear end shown in FIG. 12 as the nut sleeve is completely fitted to the nut.

The nineth embodiment of this invention is to be described referring to FIG. 12 through FIG. 14, wherein the reference numeral 1 denotes a frame for driving power source such as an electric motor, hydraulic motor, pneumatic motor, and the like (not shown), 2 a rotating shaft of said driving power source, 5*a* a first gear provided at the top of said shaft 2, 50 a second hollow gear engaging with said first gear 5*a* in the speed reduction ratio, 5 a hollow rotating shaft fitted to said second gear 50 and 6 a gear box connected to said frame 1 and containing said first gear 5*a* and second gear 50 and it rotatably supports said rotating shaft 2 by way of a ball bearing 7. 6*a* is an aperture provided through said gear box 6, 6*b* a plural of stepped apertures provided through the outer periphery of said gear box 6 (only one of them is shown in the drawing), 61 a circular metal part fitted by screwing in the inner surface of said stepped apertures 6*b* and 62 a guide member connected to the inner surface of said gear box 6 and provided with aperture 62*a* therethrough. 63 is an engaging member losely fitted in the slotted groove (not shown) of said guide member 62 and having at one thereof an engaging pawl 63*a*. 64 is a lever moving up and down which is losely inserted through the aperture 6*a* of said gear box 6 with one end thereof projecting outside of said gear box 6 and the other end thereof being connected to said engaging member 63 by a nut 65 and 11 a bearing support losely fitted in the inner surface of said gear box 6 and it includes a circular groove 11*a* for losely engaging therein said circular metal ring 61 and rotatably supports said rotating shaft 5 by way of ball bearings 12. 13 is an elliptical wave generator fitted to said rotating shaft 5, 14 ball bearings fitted to the outer periphery of said wave generator 13 and 15 a flexspline consisting of resilient material having U-shaped section and provided at the outer periphery of said ball bearings 14 and it is provided at the outer cylindrical surface thereof with predetermined number of teeth. This flexspline 15 is flexed in the elliptical configuration so as to correspond to the ball bearings 14. 16 is an internal gear connected to said bearing support 11 and provided at the inner surface thereof opposing to said flexspline 15 inner teeth engaging with the external teeth of said flexspline 15, the number of the inner teeth being greater than that of said external teeth by one or two. 17 is a first case connected to internal gear 16 and 18 is a sun gear shaft connected to said flexspline 15 and having an aperture 18*b* and it is connected rotatably to said first case 17 by way of the bearings 19. 18*a* is a first sun gear provided on the outer periphery of said sun gear shaft and 66 is a ball bearing fitted to the inner surface of one end of said flexspline and rotatably supporting said rotating shaft (5). 20 are plural first planetary gears engaging said first sun gear 18*a* and said planetary gears revolute with rotation 21 is a first planetary gear shaft rotatably supporting said first planetary gear 20 and 22 is a first planetary gear stand having aperture 22*b* on which said first planetary gear shaft 21 is connected and supported and rotatably supported by the ball bearings 23 and metal 24. 22*a* denotes a second sun gear provided on the outer periphery of the top of said first planetary gear stand 22, 25 a second case connected to said first case, 25*a* a first internal gear provided on the inner surface of said second case 25 and engaging with first planetary gear. 25*b* denotes a second internal gear provided on the other inner surface of said second case 25, 35*a* a male screw thread provided on the outer periphery of one end of said second case, 35*b* projections provided at the top of said second case 25 at an interval of 120° as shown in FIG. 2, and 26 are plural second planetary gears engaging said second sun gear and revolving under rotation while engaging said inner teeth 25*b*. 27 indicates a second planetary gear shaft rotatably supporting said second planetary gear 26, and 28 is a second planetary gear stand on which said second planetary gear shaft 27 is connected and supported and which is, inturn, rotatably supported by the ball bearing 29 and metal 30. 28*a* is an aperture provided through the inner surface of said second planetary gear stand 28 and said aperture is fitted with metal 66 which, in turn, rotatably supports one end of said first planetary gear stand 22. 28*b* is a hexagonal recess provided on the inner surface of one end of said second planetary gear stand 28 and 67 is a hollow bolt having hexagonal outer periphery and axially slidable while being losely inserted within the hexagonal recess 28*b*, the inner surface of one end thereof being provided with hexagonal hole 67*a* and the outer surface of said end thereof being formed with head portion 67*b*. 67*c* is an aperture provided at right angles with the hexagonal hole 67*a* of said hollow bolt receptacle 67, 68 a steel ball losely engaged within said aperture 67*c* and 69 a compression coil spring intervened through said aperture 67*c* and 70 a cover provided on the upper part of said aperture 67*c* for preventing the projection of said compression coil spring from said aperture 67*c*. 71 is a hollow stopper tightly fitted to the inner surface of said bolt receptacle 67 and 72 is a compression coil spring intervened between the top of said second planetary gear stand 28 and the stepped portion 67*b* of said bolt receptacle 67 and said spring presses said bolt receptacle 67 to the left in the drawing. 36 is a nut sleeve provided around the outer periphery of said bolt receptacle 67 spaced apart concentrically, one end thereof being provided with engaging portions 36*a* that are formed at an interval of 120° so as to engage with the projections 35*b* of said second case 25 and the other end being provided with on the inner surface of the other end thereof hexagonal hole 36*c*. 73 is a rising rod adapted so as to pass through the aperture of said rotation shaft 5, aperture 18*b* of said sun gear shaft 18 and aperture 22*b* of the second planetary gear shaft and also adapted so that it can engage into the aperture 62*a* of said guide member 62. 73*a* is an engaging portion provided on one end of said rising rod and adapted to engage with the engaging pawl 63*a* of said engaging member 63. 74 is an inertia weight connected to the other end of said rising rod 73 the greater diameter portion of which is formed greater than that of the hole diameter of said hollow stopper 71. 74*b* shows a top portion of said inertia weight 74 that is connected to said greater diameter portion 74*a* and the outer periphery thereof is formed smaller than the hole diameter of said stopper 71. 75 is a compression coil spring that is intervened between the bottom end of the hexagonal hole 28*b* of said second planetary gear stand 28 and the end face of the greater diameter portion 74*a* of said inertia weight 74 and it rapidly moves said rising rod 73 to the left in the drawing due to the inertia force of said inertia weight 74 when the engaging portion 73*a* of said rising rod 73 and the engaging pawl 63*a* of said engaging member 63 disengage. 76 is a compression coil spring intervened between the outer periphery of said gear box 6 and the projection of said lever 64 for moving up and down and it normally depresses said engaging member 63 downward by way of said lever 64 due to the spring force to thereby engage the engaging portion 73*a* of said rising rod 73 to the engaging pawl 63*a* of said engaging member 63. 40 and 41 are a pair of clamped articles having apertures 40*a* and 41*a* respectively. 43 denotes a torque set bolt inserted through said apertures 40*a* and 41*a*, 43*a* a smaller diameter portion formed on said torque set bolt 43 and 43*b* a hexagonal projection provided at the top of said smaller diameter portion and said projection engaged into the hexagonal hole 67*a* in the bolt receptacle 67. 44 and 45 are a pair of washers losely engaged to said torque set bolt 43 and 32 a hexagonal nut screwed with said torque set bolt and said nut is fitted into the hexagonal hole 36*c* of said nut sleeve 36. 37 is a joint screwed to the male screw 35*a* of said second case 25.

The operation of the above described embodiment having the foregoing construction is to be described. The torque set bolt 43 is losely fitted with the washer 45 at first and then inserted through respective apertures 40*a* and 41*a* of a pair of clamped articles 40 and 41. Then the washer 44 is losely fitted thereto and the bolt is further screwed with the hexagonal nut 32. After that, the hexagonal projection 43*b* of the torque set bolt 43 is fitted into the hexagonal hole 67*a* of the bolt receptacle 67 and the hexagonal nut 32 is fitted into the hexagonal hole 36*c* of the nut sleeve 36. FIG. 12 represents said fitting state in the initial stage. By completely fitting the hexagonal nut 32 to the nut sleeve 36 and the torque set bolt 43 to the bolt receptacle 67 as shown in FIG. 13, the rising rod moves against the spring force of the compression coil spring 75 to the right in the drawing and thus lifts the engaging member 63 upward against the spring force of the compression spring coil spring 76 by the engaging portion 73*a* thereof to fit the same into the aperture 62*a* through the guide member 62. The engaging member 63 again lowers due to the spring force of the compression coil spring 76 to thereby engage the engaging portion 73*a* of the rising rod 13 and the pawl of the engaging member 63 to attain the condition shown in FIG. 14. In this case, a clearance is formed between the tip portion 74*b* of the inertia weight 74 and the projection 43*b* of the torque set bolt 43.

Then, by the rotation of the driving power source in the direction of clamping, the rotating shaft 2 and the first gear 5*a* are rotated. The rotation of the first gear 5*a* causes to rotate the second gear 50, rotating shaft 5 and a wave generator 13 and this rotation moment is transmitted through the flexspline 15, first sun gear 18*a*, first planetary gear 20, first planetary gear shaft 21, first planetary gear stand 22, second sun gear 26, second planetary gear shaft 27, second planetary gear stand 28, and then to bolt receptacle 67. Since the bolt receptacle is fitted with the hexagonal projection 43*b* of the torque set bolt 43, the rotation of the bolt receptacle 67 is hindered thereby causing to rotate internal gear 16, bearing support 11, first case 17, second case 25, joint 37, nut sleeve 36 thus to rotate the nut 32. Then, the clamped articles 40 and 41 are gradually clamped by way of the washer 44. Thus, as the tightening torque to the clamped articles 40 and 41 increases, the reaction force exerted on the torque set bolt 43 is also increased in proportion thereto. When the tightening torque exceeds a predetermined value, the smaller diameter portion 43*a* of the torque set bolt 43 is broken and a pair of the clamped articles 40 and 41 are tightened with a prescribed tightening torque, while the hexagonal projection portion 43*b* of the torque set bolt 43 as a broken place is pressed by a steel ball 68 which is, inturn, pressed by the compression coil spring 69 inserted through the aperture 67*c* in the bolt receptacle 67 and stopped still. When the torque set bolt is broken, the inhibition to rotation of the bolt receptacle 67 is removed and said bolt receptacle is releaved and therefore rotates under nonloaded condition. On the contrary, the nut sleeve 36, second case 25, first case 17, internal gear 16, bearing support 11 stop rotation. Finally, the driving power source is stopped and the clamping tool is moved to the side of the clamped articles to disengage the nut 32 from the nut sleeve 36. The, with raising of the lever 64 against the spring force of the compression coil spring 76 upward, the engaging member 63 is elevated to disengage itself from the engaging portion 73*a* of the rising rod 73 thereby rapidly moving the rising rod 73 by the spring force of the compression coil spring 75 and the inertia of the inertia weight 74 to the side of the broken piece so as to discharge said piece outside of the clamping tool.

Figure 15:
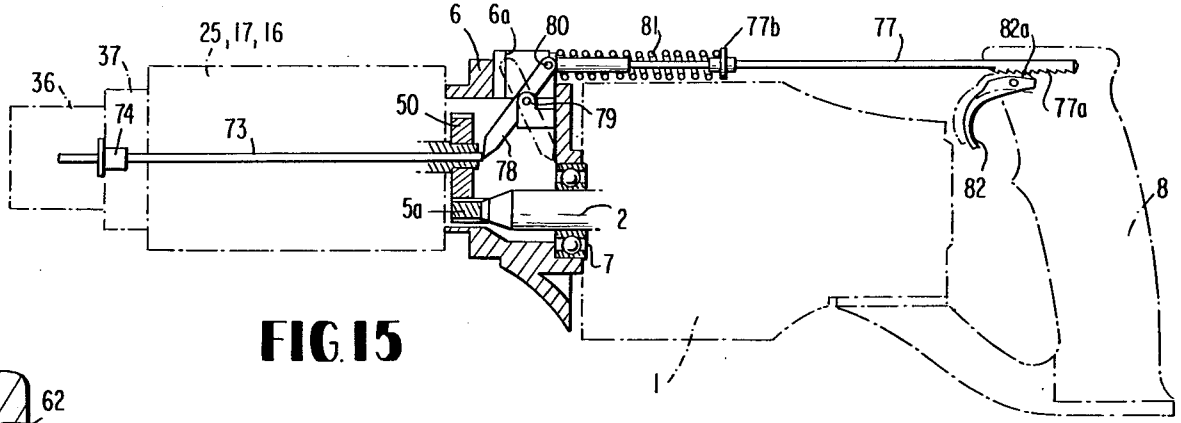
FIG. 15 is a partially cut away elevation of a tenth embodiment of this invention.

The 10th embodiment of this invention is to be described referring to FIG. 15, wherein reference numeral 73 denotes a rising rod the top of which is adapted so as to freely passing through the bolt receptacle (not shown). 77 is a moving frame movably provided outside of the frame 1 and the one end thereof is provided with a rack 77*a* inserted through the handle 8. 77*b* is a flange formed at an intermediate portion of said moving rod 77 and 6 is a gear box connected to said frame 1 and having opening 6*a*. 78 denotes a push lever pivotted to said gear box 6 by way of a pin 79, 80 a pin for hinding said moving lever 77 and said push lever 78, 81 a compression spring coil intervened between said flange 77*b* and said push lever 78 and 82 a pivot handle having an engaging portion 82*a* for the engagement of the rack 77*a* of said moving lever 77. Other constructions are omitted to explain since they are the same as in the embodiment 9. The operation of the above described embodiment is to be described. When the bolt receptacle 67 is fitted to the hexagonal projection 43*b* of the torque set bolt 43 in clamping the torque set bolt 43, the rising rod 73 retracts to rotate the push lever 78 to the location shown in the dotted line and thereby advancing the moving lever 77 against the spring force of the compression coil spring 81. In other word, the spring energy of said compression coil spring 81 is stored thereby and the moving position is kept by the engagement between the engaging portion 82*a* of the pivot handle 82 and the rack 77*a*. In the same operation as described in the foregoing embodiment 9, the clamped articles 40 and 41 are tightened by an appropriate tightening torque to broke the smaller diameter portion 43*a* of the torque set bolt 43. In this state, the driving power source is stopped, the engagement between the nut sleeve 36 and the nut 32 is released and the pivot handle 82 is pivotted to the position shown by the dotted line. Then, the rack 77*a* is freed from the engaging portion 82*a* and moved by means of the spring force of the compression coil spring 81 to the side of the handle 8, while the push lever 78 pivots to the position shown by solid line thereby causing the rising rod 73 to move to the side of the bolt receptacle 67 and discharge the broken piece by means of the top portion 74*b* of the inertia weight 74 outside of the tool. Other operations are the same as in the nineth embodiment and, therefore, omitted here.

Figure 16:
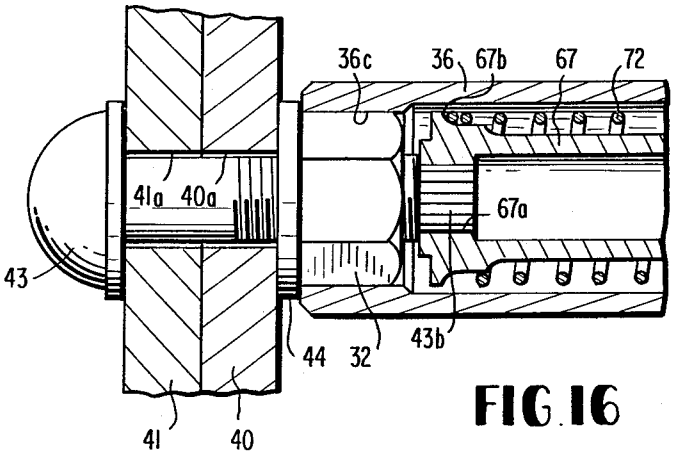
FIG. 16 is a partially cut away elevation of an eleventh embodiment of this invention.

The 11th embodiment of this invention is to be described referring to FIG. 16, wherein reference number 43 is a bolt inserted through the apertures 40*a* and 41*a* of the clamped articles 40 and 41 and having at the top thereof a hexagonal projection 43*b*, 32 a hexagonal nut screwed to said bolt 43 by way of a washer 44, 36 a nut sleeve engaged to the hexagonal nut and having hexagonal holes 36*c* at the inner surface thereof and 67 a bolt receptacle having hexagonal hole 67*a* fitted with the hexagonal projection 43*b*. Other constructions are omitted here since they are the same as in the nineth embodiment of this invention.

In the above described embodiment, the bolt 43 is inserted through the apretures 40*a* and 41*a* of the clamped articles 40 and 41 and the hexagonal nut 32 is screwed to the bolt 43 by way of the washer 44. Then, the nut sleeve 36 is fitted to the nut 32 and the bolt receptacle 67 is fitted to the bolt 43 and the driving power source is rotated in the direction of clamping. Then, the nut sleeve 36 is rotated by the rotation of said power source and gradually tightens the clamped articles 40 and 41. Since the bolt 43 is held by the bolt receptacle, slipping can be prevented and the nut 32 is tightened to the clamped articles 40 and 41. Other operations are the same as in the ninth embodiment and, therefore, omitted to explain.

Operation of the embodiment has been described with respect to the clamping of the clamped articles, the losening of the clamped articles can be effected in the similar procedures by reversely rotating the driving power source.

The clamping tool according to this invention having the foregoing construction can provides a high speed reduction ratio and can clamp the clamped articles with a great torque. It is of reduced size and light weight and enables easy maintenance and inspection. In addition, since an anti-rotation portion is provided on the tool, the rotation of the tool due to the reaction force of the tightening torque can be prevented and the fatigue of the tool carrying worker is greatly reduced. Moreover, since the stationary portion of the speed reduction mechanism is made rotatable relative to the handling portion, the handling portion is not rotated even if the portion of the tool is rotated by the reaction force of the tightening torque in the case if the anti-rotation portion should fail to serve its function. Such a double safety mechanism as above can prevent the damage on the tool or the occurence of the human accidents due to the reaction force of the reaction torque. Further, since a sleeve is provided to the stationary portion of the speed reduction mechanism detachably and pivotally in a predetermined angle in the tool of this invention, the anti-rotation portion can be rotated within said angle and thus can select the adjacent nut to be engaged with the anti-rotation portion in a certain range. Also, sleeve and receptacle can be replaced depending on the diameter of the nut and bolt. In addition, in the embodiment of the clamping tool of this invention in which the torque set bolt is used, a rising rod having inertia weight and moving axially, a spring means forcing the rising rod to the torque set bolt, engaging mechanism regulating the movement of the rising rod, and the engagement releasing mechanism for releasing said engaging mechanism. Therefore, by the release of the engagement release mechanism, the broken piece of the torque set bolt can be positively discharged outside of the tool by the strong stroke of the rising rod due to the resilient force of the spring means stored therein.

While the invention has been described in detail and with reference to specific embodiments thereof, it will be apparent to one skilled in the art that various changes and modifications can be made therein without departing from the spirit and scope thereof.

What is claimed is:

1. A power wrench comprising:

a case, a harmonic drive mechanism, at least one planetary gear device incorporated in said case and connected to said harmonic drive mechanism for reducing the output speed of said harmonic drive mechanism, a first mechanism driven by said at least one planetary gear device and rotating a nut screwable on a torque set bolt, a second mechanism driven by said at least one planetary gear device engaging a projection portion of said torque set bolt and rotating said projection portion, said second mechanism including a fitting portion fitting to the projection portion of said torque set bolt, said first mechanism having a cylindrical portion fitted to said nut, said second mechanism fitting portion comprising a cylindrical bore, a cylindrical inertia weight slidably mounted within said fitting portion bore, axially of said projection portion of said torque set bolt, means for spring biasing said inertia weight into contact with said projection portion of said torque set bolt when received by said second mechanism fitting portion, with said projection portion axially shifting said inertia weight within said bore and compressing said biasing means, a rod fixed to and extending axially from said inertia weight in a direction away from said torque set bolt, and a displaceable engaging member engagable with the end of said rod remote from said inertia weight to releasably latch said rod with said inertia weight axially displaced under spring compression and in abutment with the projection portion of said torque set bolt prior to torquing of said set bolt and severance of the smaller diameter portion of said torque set bolt due to the rotation of said projection portion.

2. The power wrench as claimed in claim 1, wherein said second mechanism fitting portion is of tubular form and surrounds the projection portion of said torque set bolt, and wherein said tubular portion includes a radial bore facing the projection portion of said torque set bolt and said bore carries a spring biased ball for contacting the periphery of said torque set bolt projection portion to frictionally maintain the severed projection portion of said torque set bolt after torquing of said torque set bolt.

3. The power wrench as claimed in claim 1, wherein said case further comprises a release lever operatively coupled to said engaging member for shifting said engaging member between a first position in which said rod and said inertia weight are latched under spring bias and a second position wherein said rod and said inertia weight is released for axial shifting towards said torque set bolt to discharge the severed projection portion of said torque set bolt from said second mechanism fitting portion, and wherein said power wrench further comprises means for spring biasing said release lever and said engaging member into rod locking engagement with said rod.

4. The power wrench as claimed in claim 2, wherein said case further comprises a release lever operatively coupled to said engaging member for shifting said engaging member between a first position in which said rod and said inertia weight are latched under spring bias and a second position wherein said rod and said inertia weight is released for axial shifting towards said torque set bolt to discharge the severed porjection portion of said torque set bolt from said second mechanism fitting portion, and wherein said power wrench further comprises means for spring biasing said release lever and said engaging member into rod locking engagement with said rod.

5. A power wrench comprising:

a case composed of a first case portion carrying an attached handle and a second case portion rotatably mounted relative to said first case portion, a harmonic drive mechanism incorporated within said case and being driven by a driving power source, at least one planetary gear device incorporated within said case connected to said harmonic drive mechanism and reducing the output speed of said harmonic drive mechanism, a first mechanism mounted to said second case portion and engaged with a nut screwed to a torque set bolt, a second mechanism driven by said at least one planetary gear device and engaging a projection portion of said torque set bolt to thereby rotate said projection portion, with said second case portion being rotatable due to the reaction force generated at the time of torquing said nut relative to said torque set bolt, said second mechanism comprising a cylindrical portion including a bore mated to and closely receiving the projection portion of said torque set bolt, said cylindrical portion being further provided with a counterbore to the side remote from said torque set bolt, an inertia weight slidably mounted within said counterbore portion, a coil spring carried by said case and spring biasing said inertia weight towards said torque set bolt for contact with said projection portion such that engagement of said second mechanism cylindrical portion with said torque set bolt projection portion upon insertion therein causes said inertia weight to be shifted axially to compress said spring, and means for releasably latching said inertia weight in said spring compressed axially shifted position prior to relative rotation of said torque bolt projection portion and said nut and severance of said nut such that said severed nut may be selectively discharged by release of said releasable latching means.

6. The power wrench as claimed in claim 5, wherein said cylindrical portion of said second mechanism carries a spring biased detent ball for contact with the periphery of the torque set bolt projection portion upon insertion within said cylindrical portion of said second mechanism to frictionally retain the severed torque set bolt projection portion until discharge therefrom by release of said releasable latching means.

7. The power wrench as claimed in claim 5, wherein said releasable latching means comprises a rod fixed to said inertia weight, and extending through said case and respective centers of revolution of said planetary gear device and said harmonic drive mechanism, an engaging member movably mounted to said case for selectively engaging the end of said rod remote from said inertia weight and a release lever, operatively coupled to said engaging member and movable between a first position wherein said release lever causes said engaging member to latch said rod and said inertia weight in an axially shifted position resulting from insertion of said torque set bolt projection portion within said second mechanism cylindrical portion with said spring compressed and a second position in which said rod is released, said spring is expanded and said inertia weight discharges the severed torque set bolt projection portion.

8. The power wrench as claimed in claim 7, wherein said release lever comprises an axially shiftable rod fixed to said engaging member and movable at right angles to the axis of said rod and said rod carries a compression spring for biasing said release lever rod to said first position.

* * * * *